US007978994B2

(12) United States Patent
Ogihara et al.

(10) Patent No.: US 7,978,994 B2
(45) Date of Patent: Jul. 12, 2011

(54) IMAGE FORMING APPARATUS INCLUDING DETECTOR UNITS

(75) Inventors: Atsushi Ogihara, Kanagawa (JP); Atsuyuki Kitamura, Kanagawa (JP); Masahiro Sato, Kanagawa (JP); Junichi Murakami, Kanagawa (JP); Satoru Torimaru, Kagoshima (JP); Tetsuji Okamoto, Kanagawa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 51 days.

(21) Appl. No.: 12/509,827

(22) Filed: Jul. 27, 2009

(65) Prior Publication Data

US 2010/0226667 A1 Sep. 9, 2010

(30) Foreign Application Priority Data

Mar. 6, 2009 (JP) ..... 2009-053433

(51) Int. Cl.
*G03G 15/00* (2006.01)
*G03G 15/20* (2006.01)

(52) U.S. Cl. ..... 399/67; 399/45; 399/401

(58) Field of Classification Search ..... 399/16, 399/45, 67, 389, 401; 347/19
See application file for complete search history.

(56) References Cited

U.S. PATENT DOCUMENTS

| | | | | |
|---|---|---|---|---|
| 5,285,247 | A * | 2/1994 | Itoh | 358/300 |
| 2005/0174377 | A1* | 8/2005 | Fujikura | 347/19 |
| 2007/0201893 | A1* | 8/2007 | Yamazaki | 399/82 |

FOREIGN PATENT DOCUMENTS

| | | | |
|---|---|---|---|
| JP | 63-005368 | | 1/1988 |
| JP | 04-288560 | | 10/1992 |
| JP | 10-218427 | | 8/1998 |
| JP | 2005-112543 | | 4/2005 |
| JP | 2007-304170 | A * | 11/2007 |
| JP | 2008-037532 | | 2/2008 |

* cited by examiner

*Primary Examiner* — Sophia S Chen
(74) *Attorney, Agent, or Firm* — Fildes & Outland, P.C.

(57) ABSTRACT

An image forming apparatus includes an image forming unit that forms an image on a recording medium; a fixing unit that fixes the image formed on the recording medium by the image forming unit by applying heat; a first detector unit that detects a length of the recording medium in a transport direction, the first detector unit being disposed upstream of the fixing unit in the transport direction; and a second detector unit that detects the length of the recording medium in the transport direction, the second detector unit being disposed downstream of the fixing unit in the transport direction.

8 Claims, 9 Drawing Sheets

CONTROLLER 66

S10

S20

IMAGE FORMING APPARATUS INCLUDING DETECTOR UNITS

CROSS-REFERENCE TO RELATED APPLICATIONS

This application is based on and claims priority under 35 USC 119 from Japanese Patent Application No. 2009-053433 filed Mar. 6, 2009.

BACKGROUND

Technical Field

The present invention relates to image forming apparatus.

SUMMARY

According to an aspect of the invention, there is provided an image forming apparatus including an image forming unit that forms an image on a recording medium; a fixing unit that fixes the image formed on the recording medium by the image forming unit by applying heat; a first detector unit that detects a length of the recording medium in a transport direction, the first detector unit being disposed upstream of the fixing unit in the transport direction; and a second detector unit that detects the length of the recording medium in the transport direction, the second detector unit being disposed downstream of the fixing unit in the transport direction.

BRIEF DESCRIPTION OF THE DRAWINGS

An exemplary embodiment of the present invention will be described in detail based on the following figures, wherein.

DETAILED DESCRIPTION

In the following, an exemplary embodiment of the present invention will be described, based on the drawings.

Figure 1:
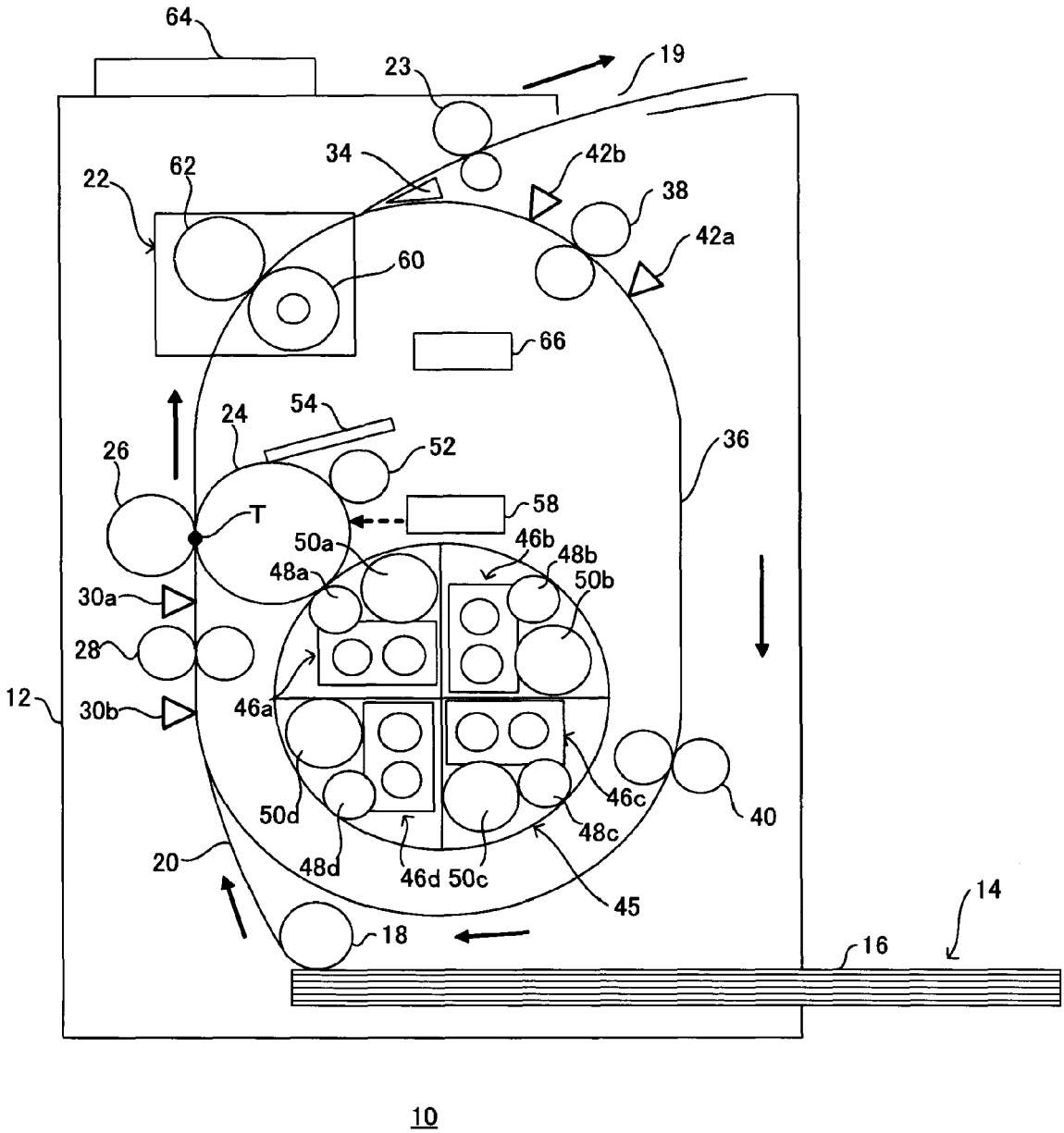
FIG. 1 is a side view depicting an overview of an image forming apparatus according to an exemplary embodiment of the invention.

FIG. 1 depicts an overview of an image forming apparatus 10 according to an exemplary embodiment of the invention. The image forming apparatus 10 has an image forming apparatus chassis 12 and a paper feed unit 14 which may have, for example, one stage disposed in the bottom of the image forming apparatus chassis 12.

The paper feed unit 14 includes a paper cassette 16 in which recording media such as paper are contained. At the top of the paper cassette 16, a pickup roller 18 is disposed to pick up a recording medium from the paper cassette 16.

The pickup roller 18 is driven by a driving mechanism which is not shown and rotates so that a recording medium is transported through the transport path 20 toward a transfer position transfer position T to be described later. The transport path 20 is the passage for a recording medium from the pickup roller 18 up to the ejection port 19. Eject rollers 23 are disposed in proximity to the ejection port 19.

Along the transport path 20, upward of a fixing device 22, an image carrier 24 and a transfer roller 26 having an elastic surface are disposed. Upward of the image carrier 24 and the transfer roller 26, registration rollers 28 are disposed. The registration rollers 28 are substantially cylindrical and transport a recording medium at a predetermined transport speed by rotating, while nipping the recording medium therebetween at predetermined timing. A position where the image carrier 24 contacts the transfer roller 26 is the transfer position T where a developer image present on the image carrier 24 is transferred to the recording medium.

Downstream of the registration rollers 28, a first sensor (first lead edge detector) 30*a*, which is, for example, an optical sensor, is disposed to detect the lead edge of a recording medium in the transport direction during recording medium transportation by the registration rollers 28. Upstream of the registration rollers 28, a second sensor (first trail edge detector) 30*b*, which is, for example, an optical sensor, is disposed to detect the trail edge of a recording medium in the transport direction during recording medium transportation by the registration rollers 28. The first sensor 30*a* and the second sensor 30*b* are, for example, mounted on one member and constitute a part of a first detector part that detects the length of a recording medium during recording medium transportation by the registration rollers 28. The first sensor 30*a* may also function as a timing sensor to control timing at which an optical projection device 58 to be described later projects an electrostatic latent image on the image carrier 24.

The first sensor 30*a* and the second sensor 30*b* may be adapted to detect the length of a recording medium in an orthogonal direction with respect to the transport direction as well as the length of a recording medium in the transport direction.

Along the transport path 20, downstream of the fixing device 22, a switching device 34 is provided. By the switching device 34, the transport path 20 is made to diverge and a loopback path 36 is formed to transport again a recording medium which leaves the fixing device 22 toward the transfer position T. In the loopback path 36, transport rollers 38, 40 are provided which transport again a recording medium which leaves the fixing device 22 toward the registration rollers 28. The transport rollers 38 are substantially cylindrical and transport a recording medium at a predetermined transport speed by rotating, while nipping the recording medium therebetween.

Downstream of the transport rollers 38, a third sensor (second lead edge detector) 42*a*, which is, for example, an optical sensor, is disposed to detect the lead edge of a recording medium in the transport direction during recording medium transportation by the transport rollers 38. Upstream of the transport rollers 38, a fourth sensor (second trail edge detector) 42*b*, which is, for example, an optical sensor, is disposed to detect the trail edge of a recording medium in the transport direction during recording medium transportation by the transport rollers 38. The third sensor 42*a* and the fourth sensor 42*b* are, for example, mounted on one member and constitute a part of a second detector part that detects the length of a recording medium in the transport direction during recording medium transportation by the transport rollers 38.

The distance of the loopback path 36 from the fourth sensor 42*b* to the transfer position T and the distance of the transport path 20 are to be longer than the length of a recording medium in the transport direction. Again, the third sensor 42*a* and the fourth sensor 42*b* may be adapted to detect the length of a recording medium in an orthogonal direction with respect to the transport direction as well as the length of a recording medium in the transport direction.

Thus, a recording medium picked up by the pickup roller 18 from the paper cassette 16 of the paper feed unit 14 is guided to the transport path 20 and temporarily stopped by the registration rollers 28. Then, at predetermined timing, the recording medium is transported toward the transfer position T. When the registration rollers 28 start to transport a recording medium toward the transfer position T, the first sensor 30*a* detects the lead edge of a recording medium in the transport direction and outputs the result of detection to a controller 66 to be described later. During the recording medium transportation by the registration rollers 28, the second sensor 30*b* then detects the trail edge of the recording medium in the transport direction and outputs the result of detection to the controller 66 to be described later. The recording medium transported by the registration rollers 28 passes (transfer position T) between the image carrier 24 and the transfer roller 26. During this passage, for example, a black developer image is transferred to the recording medium and the transferred black developer image is fixed by the fixing device 22, and the recording medium is then ejected by the eject rollers 23 through the ejection port 19 (black-and-white image print mode).

However, in color image print mode, the recording medium is guided to the loopback path 36 by a switching action of the switching device 34. The recording medium guided to the loopback path 36 is transported again toward the transfer position T by the transport rollers 38 and the like. When the transport rollers 38 start to transport the recording medium, the third sensor 42*a* detects the lead edge of the recording medium in the transport direction and outputs the result of detection to the controller 66 to be described later. Furthermore, during the recording medium transportation by the transport rollers 38, the fourth sensor 42*b* detects the trail edge of the recording medium in the transport direction and outputs the result of detection to the controller 66 to be described later.

The image forming apparatus 10 is configured to detect the length of a recording medium, for example, in the transport direction, according to the results of the detection by the first sensor 30*a*, the second sensor 30*b*, the third sensor 42*a*, and the fourth sensor 42*b*, and form a corrected image on the recording medium adaptively to the detected length of the recording medium.

The recording medium guided to the loopback path 36 circulates so that is passes the registration rollers 28 four times in all. That is, the recording medium passes the registration rollers 28, the transfer position T, and the fixing device 22 four times in all and is then ejected through the ejection port 19.

In the image forming apparatus chassis 12, a rotary development device 45 is disposed, for example, in a lower section approximately in the middle of the chassis. The rotary development device 45 includes development units 46*a* to 46*d* respectively containing four colors of developers, i.e., yellow, magenta, cyan, and black developers. The development units 46*a* to 46*d*, respectively, include development rollers 48*a* to 48*d* and developer containers 50*a* to 50*d* which are removable. The development units 46*a* to 46*d*, respectively, supply the developers contained in the developer containers 50*a* to 50*d* to the development rollers 48*a* to 48*d* and make an electrostatic latent image present on the image carrier 24 visible with each color developer in turn.

In front of the image carrier 24, a charging device 52, which is formed of, for example, a charging roller, is provided to evenly charge the image carrier 24. Furthermore, an image carrier cleaner 54 abuts on the image carrier 24, upstream relative to the charging device 52 in the direction of rotation of the image carrier 24. The image carrier cleaner 54 scrapes away developer particles remaining on the image carrier 24 after transfer.

Above the rotary development device 45, the optical projection device 58 is disposed that projects an electrostatic latent image on the image carrier 24 charged by the charging device 52, using a beam such as a laser beam. At the rear side of the image carrier 24, the above-mentioned transfer roller 26 is located. The transfer roller 26 overlayingly transfers each developer image made visible with each of the developer 46*a* to 46*d* sequentially onto a recording medium in the transfer position T.

Downstream of the transfer position T, the fixing device 22 is disposed. The fixing device 22 includes a heating roller 60 and a pressure roller 62 which apply heat and pressure to a recording medium having a developer image transferred thereto being passed therebetween, thereby fixing the developer image onto recording medium and further transporting them.

Furthermore, in the image forming apparatus chassis 12, user interface (UI) equipment 64 such as a touch panel and the controller 66 that controls all components of the image forming apparatus 10 are disposed.

The UI equipment 64 receives an input performed by a user for setup, for example, for setting an operation mode of the image forming apparatus 10 and outputs it to the controller 66, and displays information about the operation of the image forming apparatus 10. Operation modes of the image forming apparatus 10 involve, for example, a black-and-white image print mode, a color image print mode, a sensor adjustment (calibration) mode to be described later, etc.

Figure 2:
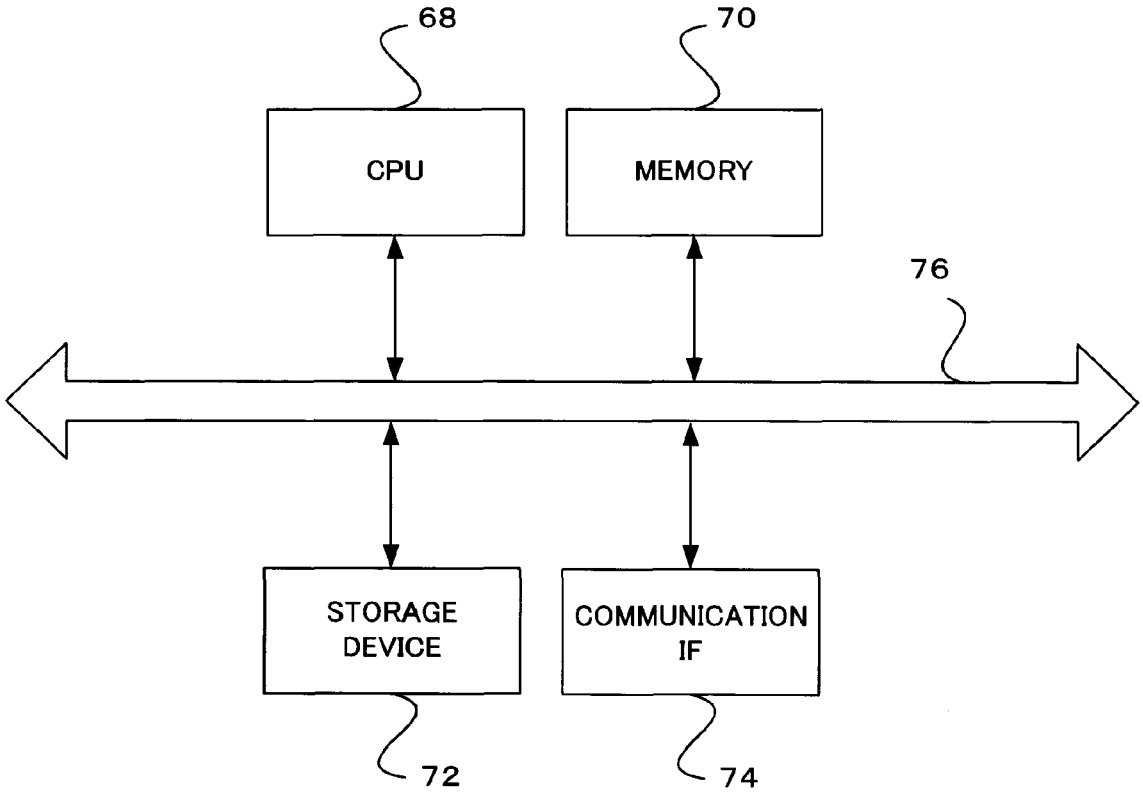
FIG. 2 is a block diagram showing a structure of a controller.

The controller 66, for example, as is illustrated in FIG. 2, is constructed by interconnecting a CPU 68, a memory 70, a storage device 72 such as a hard disk drive (HDD), and a communication interface (IF) 74 for transmitting and receiving data via a control bus 76.

The CPU 68 includes a timer or the like, which is not shown, executes predefined processing according to a program stored in the memory 70 or the storage device 72 and controls the operation of the controller 66. The program can also be stored in a storage medium such as CD-ROM and provided therefrom, instead of being provided from the memory 70 or the storage device 72. The storage medium may be a magnetic disk, a semiconductor memory, or any other storage medium. The communication IF 74 is a communication interface for establishing a connection with other equipment.

Next, an operation of the image forming apparatus 10 is described in detail, which involves detecting the length of a recording medium in plural locations and forming an image.

Figure 3:
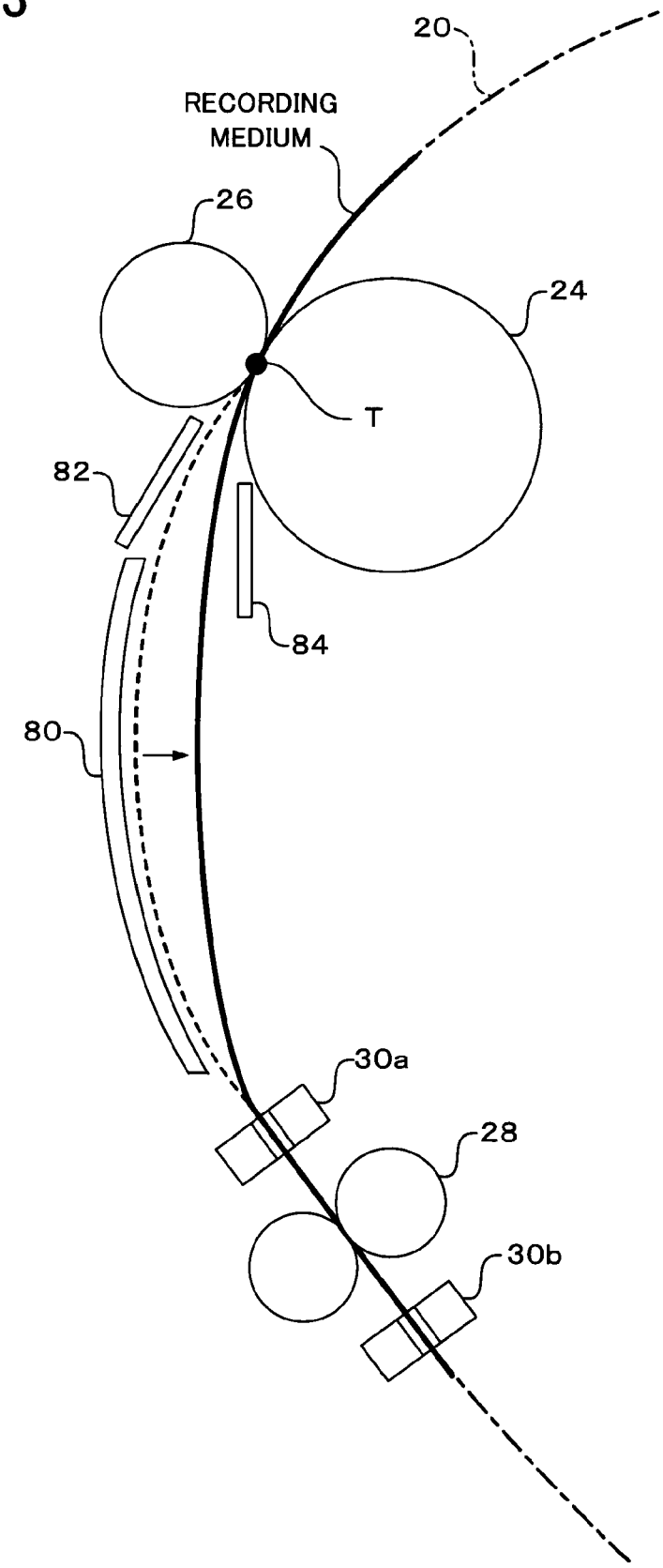
FIG. 3 is a detail view depicting a section of a transport path and its periphery from a first sensor, a second sensor, and registration rollers to a transfer position.

FIG. 3 is a detail view depicting a section of the transport path 20 and its periphery from the first sensor 30*a*, the second sensor 30*b*, and the registration rollers 28 to the transfer position T.

Guide parts 80, 82, 84 are provided in the section of the transport path 20 between the registration rollers 28 and transfer position T. The guide parts 80, 82, 84 are arranged to guide a recording medium toward the transfer position T.

When the registration rollers 28 start to transport a recording medium, the first sensor 30*a* detects the lead edge of a recording medium in the transport direction and the guide part 80 is arranged to start guiding the lead edge of the recording medium in the transport direction. The recording medium guided by the guide part 80 is then guided by the guide part 82 toward the transfer position T, as is indicated by a dashed line in FIG. 3, and transfer of a developer image present on the image carrier 24 begins. Then, the recording medium is transiently transported by the registration rollers 28, the image carrier 24, and the transfer roller 26.

Here, as is indicated by the dashed line in FIG. 3, the recording medium becomes slack between the registration rollers 28 and the transfer position T. For example, when the transport speed at which the image carrier 24 and the transfer roller 26 transport the recording medium is faster than the transport speed at which the registration rollers 28 transport the recording medium, or also when the nipping force by which the image carrier 24 and the transfer roller 26 nip the recording medium therebetween is stronger than the nipping force by which the registration rollers 28 nip the recording medium therebetween, the recording medium is transported with displacement (altering its position) toward a direction denoted by an arrow in FIG. 3. Thereby, the force produced by the image carrier 24 and the transfer roller 26 is prevented from being transmitted to the registration rollers 28 via the recording medium.

Accordingly, the first sensor 30*a* and the second sensor 30*b* are arranged so as to be capable of detecting the edges of a recording medium whose transport speed is governed by the registration rollers 28 without being influenced by the transport speed and the nipping force of the image carrier 24 and the transfer roller 26 on the recording medium.

During an interval after the first sensor 30*a* detects the lead edge of a recording medium in the transport direction until the second sensor 30*b* detects the trail edge of the recording medium in the transport direction, similarly, the recording medium is transported so that the force produced by the pickup roller 18 and the fixing device 22 is not transmitted to the registration rollers 28 via the recording medium.

Figure 4:
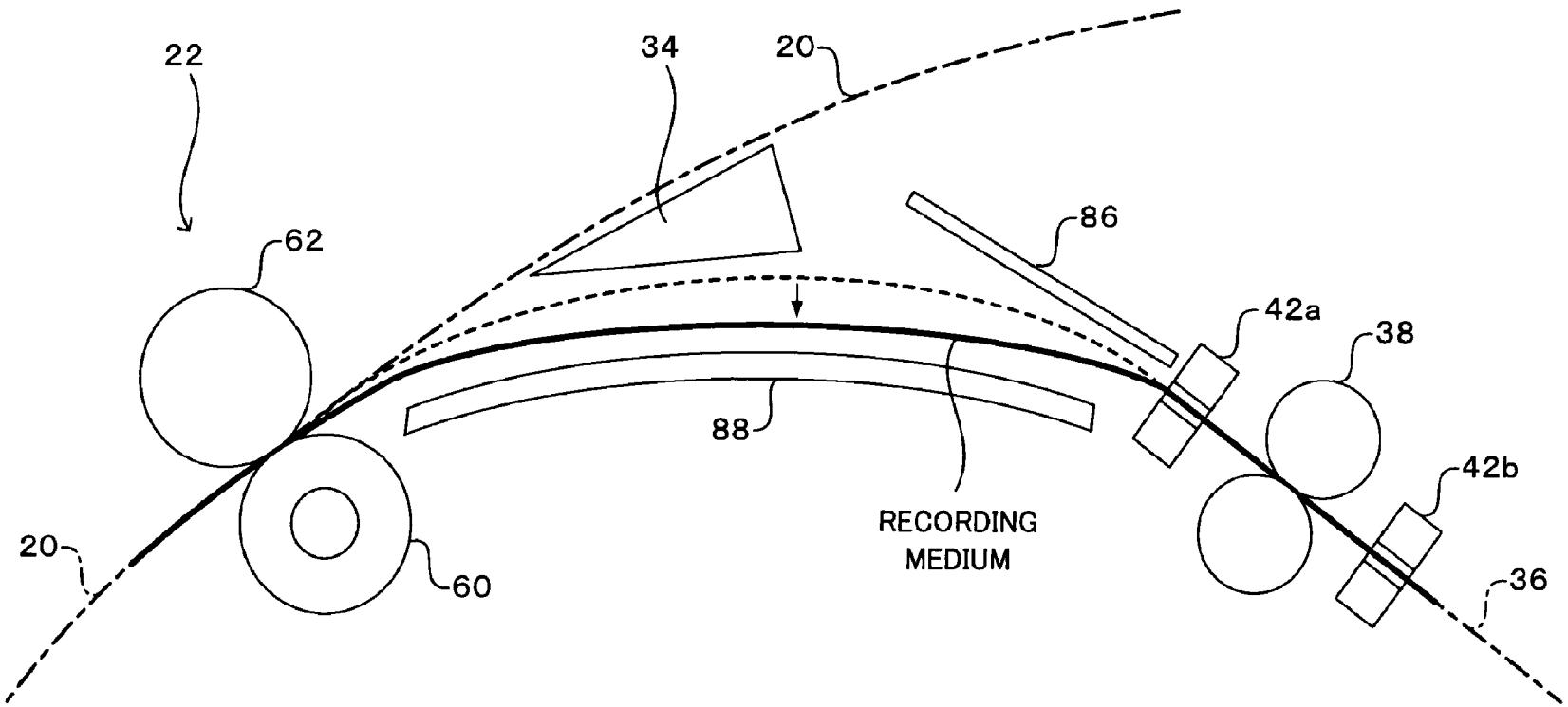
FIG. 4 is a detail view depicting a section of a loopback path from a fixing device to transport rollers as well as a third sensor and a fourth sensor and periphery thereof.

FIG. 4 is a detail view depicting a section of the loopback path 36 from the fixing device 22 to the transport rollers 38 as well as the third sensor 42*a* and the fourth sensor 42*b* and periphery thereof.

Guide parts 86, 88 are provided in the section of the loopback path 36 between the fixing device 22 and the transport rollers 38. The switching device 34 and the guide parts 86, 88 are arranged to guide a recording medium from the fixing device 22 toward the transport rollers 38.

When a recording medium is guided to the loopback path 36 by the switching device 34, it is guided by the guide part 86 toward the transport rollers 38 and the transport rollers 38 start to transport it. Then, the recording medium is transiently transported by heating roller 60 and the pressure roller 62 and the transport rollers 38.

Here, as is indicated by a dashed line in FIG. 4, the recording medium becomes slack between the fixing device 22 and the transport rollers 38. For example, when the transport speed at which the pressure roller 62 and the heating roller 60 transport the recording medium is slower than the transport speed at which the transport rollers 38 transport the recording medium, or also when the nipping force by which the pressure roller 62 and the heating roller 60 nip the recording medium therebetween is stronger than the nipping force by which the transport rollers 38 nip the recording medium therebetween, the recording medium is transported with displacement (altering its position) toward a direction denoted by an arrow in FIG. 4. Thereby, the force produced by the heating roller 60 and the pressure roller 62 is prevented from being transmitted to the transport rollers 38 via the recording medium.

Accordingly, the third sensor 42*a* and the fourth sensor 42*b* are arranged so as to be capable of detecting the edges of a recording medium whose transport speed is governed by the transport rollers 38 without being influenced by the transport speed and the nipping force of and the heating roller 60 the pressure roller 62 on the recording medium.

During an interval after the third sensor 42*a* detects the lead edge of a recording medium in the transport direction until the fourth sensor 42*b* detects the trail edge of the recording medium in the transport direction, similarly, the recording medium is transported so that the force produced by the image carrier 24 and the transfer roller 26 as well as the transport rollers 40 is not transmitted to the transport rollers 38 via the recording medium.

Figure 5:
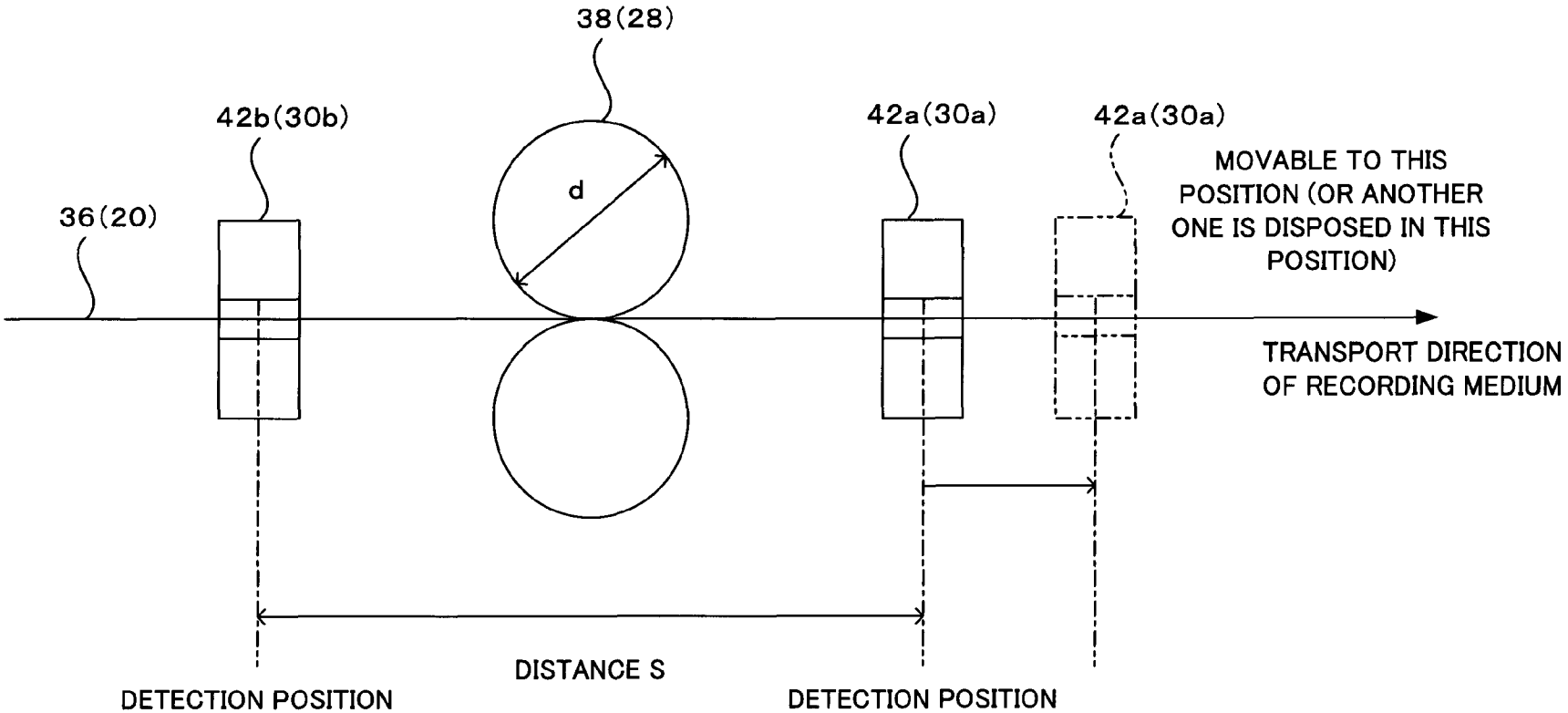
FIG. 5 schematically illustrates a relationship between the transport rollers (registration rollers) and the third sensor and the fourth sensor (first sensor and second sensor)

FIG. 5 schematically illustrates a relationship between the transport rollers 38 (registration rollers 28) and the third sensor 42*a* and the fourth sensor 42*b* (first sensor 30*a* and second sensor 30*b*).

The third sensor 42*a* is disposed downstream relative to the transport rollers 38 in the loopback path 36 and the fourth sensor 42*b* is disposed upstream relative to the transport rollers 38 in the loopback path 36. An interval (distance S) between a detection position at which the third sensor 42*a* detects the lead edge of a recording medium in the transport direction and a detection position at which the fourth sensor 42*b* detects the trail edge of a recording medium in the transport direction is defined to fulfill the following equation:

$$\text{Distance } S = L - n\pi d \quad (1)$$

Where,

L: reference length of recording medium (standard length of recording medium d: Roller diameter (diameter)

n: integer

For example, if the roller diameter d of the transport rollers 38 shown in FIG. 5 is 14 mm and a recording medium which is fed from the paper feed unit 14 is A4 size paper, and assuming that a value of the integer n is, for example, 6, the distance S between the third sensor 42*a* and the fourth sensor 42*b* to be set according to the above equation 1, is set to be 33.1 mm, as is obtained by the following equation 2.

$$\text{Distance } S = 297 - 6 \times \pi n \times 14 \approx 33.1 \text{ mm} \quad (2)$$

Where,

L: A4 size (transported in a longitudinal direction)=297 mm d: Roller diameter=14 mm n: 6

Since the time at which the third sensor 42*a* has detected the lead edge of a recording medium in the transport direction, the fourth sensor 42*b* detects the trail edge of the recording medium in the transport direction upon n turns of the transport rollers 38. That is, the rotational position (phase) of the transport rollers 38 when the third sensor 42*a* detects the lead edge of a recording medium in the transport direction is substantially equal to the rotational position (phase) of the transport rollers 38 when the fourth sensor 42*b* detects the trail edge of a recording medium in the transport direction.

In a case where the paper feed unit 14 feeds different types of recoding media having different lengths (standard lengths), like a case where the paper feed unit 14 feeds, for example, A4 size paper and B4 size paper as recording media, the image forming apparatus 10 may be configured such that, for example, the third sensor 42*a* is movable to fulfill the above equation 1. Further, the image forming apparatus 10 may be configured such that, for example, plural fourth sensors 42*b* are disposed in appropriate positions downstream of the transport rollers 38 to fulfill the above equation 1 for plural types of recording media.

Arrangement of the registration rollers 28, the first sensor 30*a*, and the second sensor 30*b* substantially corresponds to the arrangement of the transport rollers 38, third sensor 42*a*, and the fourth sensor 42*b*.

That is, the first sensor 30*a* is disposed downstream relative to the registration rollers 28 in the transport path 20 and the second sensor 30*b* is disposed upstream relative to the registration rollers 28 in the transport path. An interval (distance S) between a detection position at which the first sensor 30*a* detects the lead edge of a recording medium in the transport direction and a detection position at which the second sensor 30*b* detects the trail edge of a recording medium in the transport direction is to fulfill the above equations 1 and 2.

Figure 6:
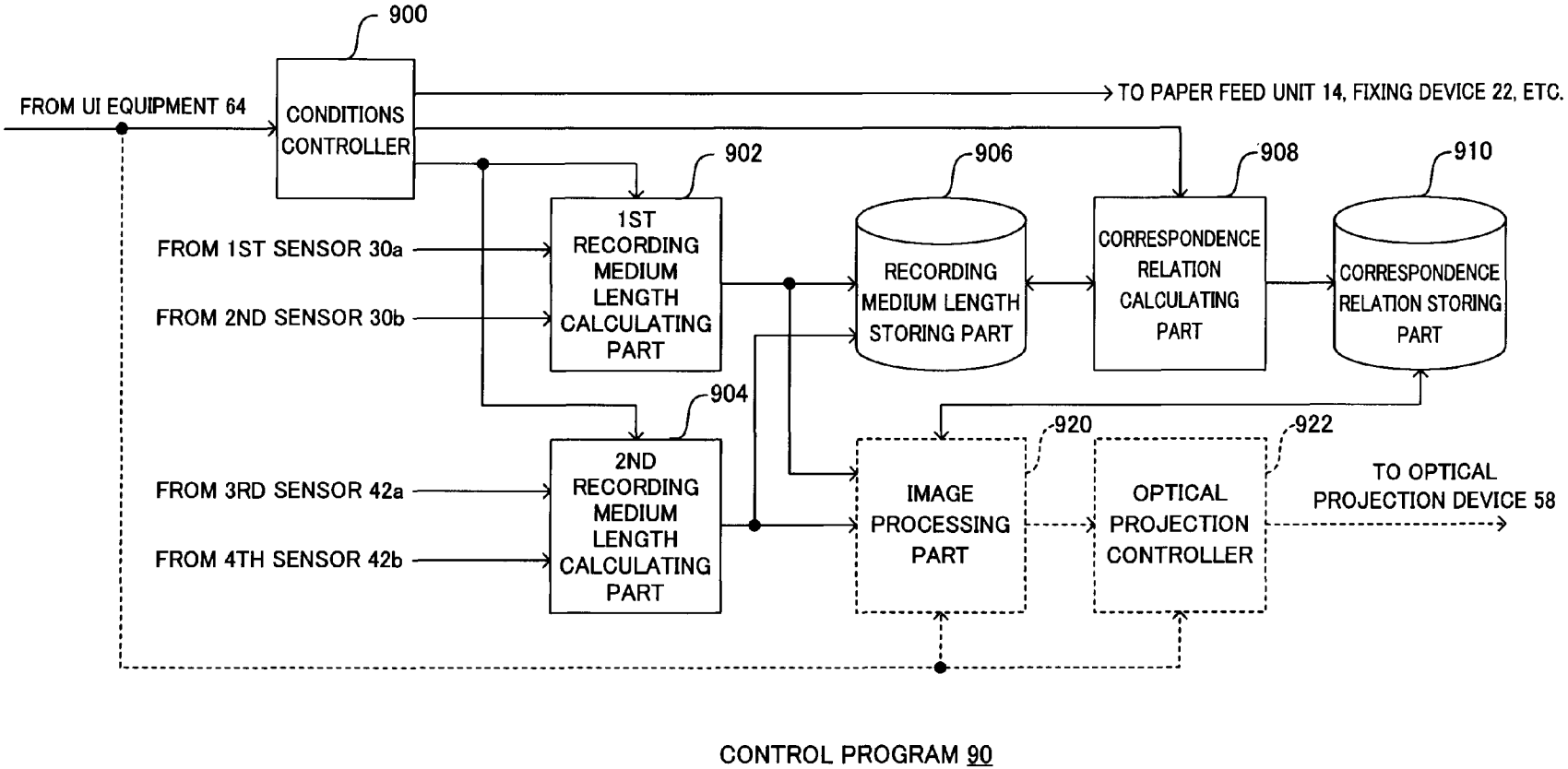
FIG. 6 illustrates a program structure of a control program.

FIG. 6 illustrates a program structure of a control program 90 which is executed by the CPU 68 for the operation of the image forming apparatus 10, which involves detecting the length of a recording medium in plural locations and forming an image.

As is shown in FIG. 6, the control program 90 is composed of a conditions controller 900, a first recording medium length calculating part 902, a second recording medium length calculating part 904, a recording medium length storing part 906, a correspondence relation calculating part 908, and a correspondence relation storing part 910. The control program 90 may also be configured to include an image processing part 920 and an optical projection controller 922 which operate, using the result of calculation from the correspondence relation calculating part 908.

The conditions controller 900 receives an input for, for example, setting an operation mode, specified by a user to the mage forming apparatus 10 via, for example, the UI equipment 64, and outputs control conditions depending on an operation mode to the first recording medium length calculating part 902, the second recording medium length calculating part 904, the correspondence relation calculating part 908, the paper feed unit 14, the fixing device 22, etc. Operation modes that the conditions controller 900 may receive involve, for example, a black-and-white image print mode, a color image print mode, a sensor adjustment (calibration) mode, etc.

The first recording medium length calculating part 902 receives the results of detection from the first sensor 30*a* and the second sensor 30*b*, calculates the length of a recording medium depending on the control conditions received from the conditions controller 900, and outputs the result of calculation to the recording medium length storing part 906 and the image processing part 920.

For example, depending on a transport speed V1 at which the registration rollers 28 transport a recording medium, an interval (distance S1) between the first sensor 30*a* and the second sensor 30*b*, the result of detection (timing of detection) Ta1 from the first sensor 30*a*, and the result of detection (timing of detection) Tb1 from the second sensor 30*b*, the first recording medium length calculating part 902 calculates the length L1 of a recording medium being now disposed upstream of the fixing device 22 (and the transfer position T).

Length L1 of a recording medium being now disposed upstream of the fixing device=(Tb1−Ta1)×V1+S1

The second recording medium length calculating part 904 receives the results of detection from the third sensor 42*a* and the fourth sensor 42*b*, calculates the length of a recording medium depending on control conditions received from the conditions controller 900, and outputs the result of calculation to the recording medium length storing part 906 and the image processing part 920.

For example, depending on a transport speed V2 at which the transport rollers 38 transport a recording medium, an interval (distance S2) between the third sensor 42*a* and the fourth sensor 42*b*, the result of detection (timing of detection) Ta2 from the third sensor 42*a*, and the result of detection (timing of detection) Tb2 from the fourth sensor 42*b*, the second recording medium length calculating part 904 calculates the length L2 of a recording medium being now disposed downstream of the fixing device 22.

Length L2 of a recording medium being now disposed downstream of the fixing device=(Tb2−Ta2)×V2 +S2

The recording medium length storing part 906 receives and stores the results of calculation from the first recording medium length calculating part 902 and the second recording medium length calculating part 904 and outputs the results, when accessed by the correspondence relation calculating part 908.

The correspondence relation calculating part 908 accesses the recording medium length storing part 906 depending on control conditions received from the conditions controller 900. From the recording medium length storing part 906, for example, the correspondence relation calculating part 908 retrieves plural results of calculation performed by the recording medium length storing part 906 and plural results of calculation performed by the second recording medium length calculating part 904. Based on these results of calculation, the correspondence relation calculating part 908 calculates a correspondence relation between the length of a recording medium detected with the aid of the first sensor 30*a* and second sensor 30*b* (the length of a recording medium being disposed upstream of the fixing device 22) and the length of the recording medium detected with the aid of the third sensor 42*a* and the fourth sensor 42*b* (the length of a recording medium being disposed downstream of the fixing device 22), and outputs the result of calculation to the correspondence relation storing part 910.

The result of calculation performed by the correspondence relation calculating part 908, for example, takes a form of a function formula for conversion that converts the length of a recording medium calculated (detected) with the aid of the first sensor 30*a* and second sensor 30*b* (the result of detection by a first detector part) to the length of the recording medium calculated (detected) with the aid of the third sensor 42*a* and the fourth sensor 42*b* (the result of detection by a second detector part). This function formula for conversion represents a correspondence relation expressed by a linear function (function formula for conversion) like the one which is, for example, illustrated in FIG. 7.

Figure 7:
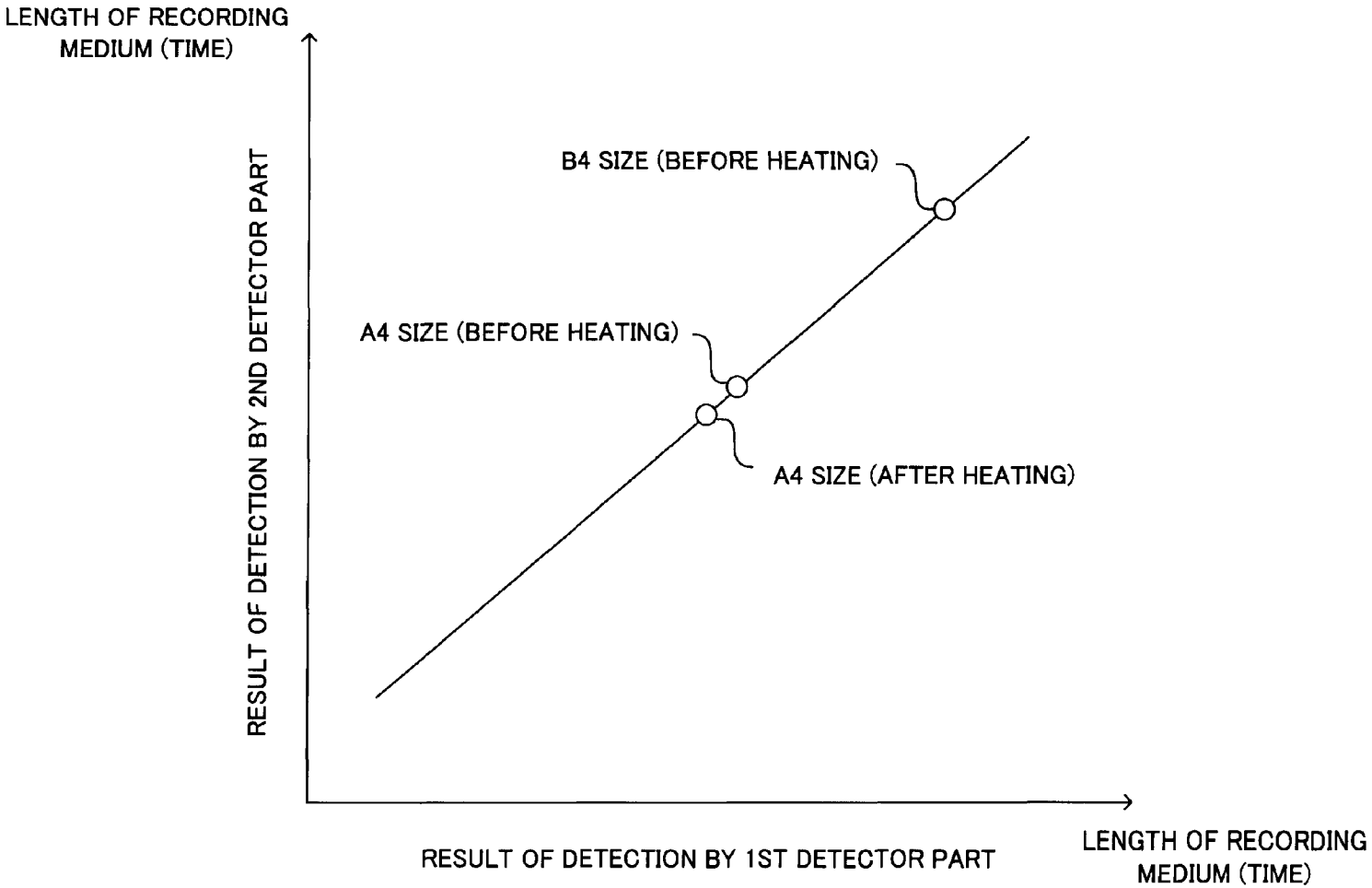
FIG. 7 is a graph representing a correspondence relation between the result of detection by a first detector part and the result of detection by a second detector part.

As is also indicated in FIG. 7, to evaluate the function formula for conversion, plural lengths of a recording medium to be correlated should be calculated. For example, plural lengths of a recording medium to be correlated may be calculated, using plural recording media of different sizes. For example, with regard to one sheet of paper, the lengths of the recording medium before and after being shrunk by heat may be calculated.

The correspondence relation storing part 910 (FIG. 6) receives and stores the result of calculation from the correspondence relation calculating part 908 and outputs the result, when accessed by the image processing part 920.

The image processing part 920 receives an input for, e.g., operation mode setting specified by a user to the image forming apparatus 10 via, for example, the UI equipment 64. The image processing part 920 also receives the results of calculation from the first recording medium length calculating part 902 and the second recording medium length calculating part 904. The image processing part 920 accesses the correspondence relation storing part 910 and performs predefined processing on image data such as image size correction, depending on the results of calculation performed by the first recording medium length calculating part 902, the second recording medium length calculating part 904, and the correspondence relation calculating part 908, and outputs the result of processing to the optical projection controller 922.

For example, when a color image print mode to be described later is set via the conditions controller 900, the image processing part 920 receives the results of calculation from the first recording medium length calculating part 902 and the second recording medium length calculating part 904, accesses the correspondence relation storing part 910, converts the result of calculation performed by the first recording medium length calculating part 902 depending on the result of calculation performed by the correspondence relation calculating part 908, performs predefined processing on image data such as image size correction depending on the result of conversion and the result of calculation performed by the second recording medium length calculating part 904, and outputs the result of processing to the optical projection controller 922.

The optical projection controller 922 receives an input for, for example, operation mode setting, specified by a user to the mage forming apparatus 10 via, for example, the UI equipment 64 and controls the optical projection device 58 depending on the result of processing received from the image processing part 920.

Figure 8:
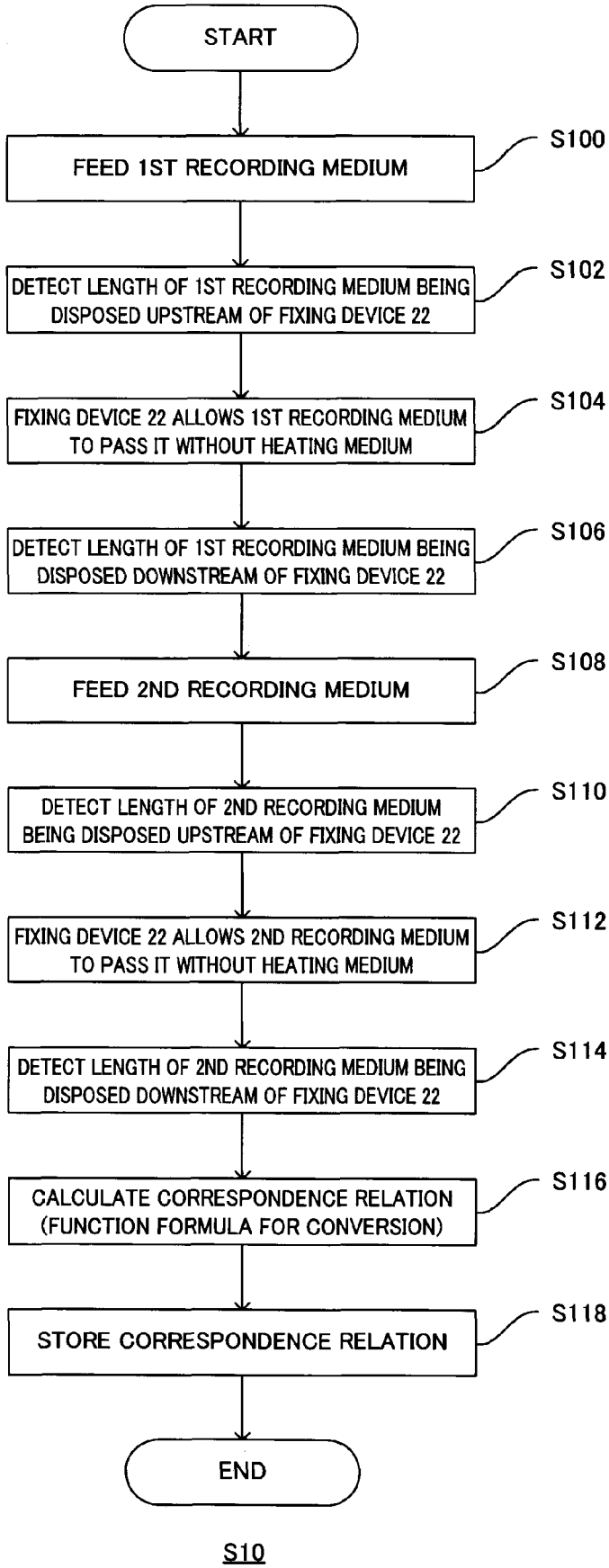
FIG. 8 is a flowchart illustrating a process (S10) that the image forming apparatus performs in a first sensor adjustment (calibration) mode.

FIG. 8 is a flowchart illustrating a process (S10) that the image forming apparatus performs in a first sensor adjustment (calibration) mode.

As is shown in FIG. 8, at step 100 (S100), the paper feed unit 14 transports (feeds) a first recording medium, e.g., A4 size paper toward the transport path 20, according to control conditions which are output by the conditions controller 900.

At step 102 (S102), the first recording medium length calculating part 902 receives the results of detection by the first sensor 30*a* and the second sensor 30*b* and calculates (detects) the length of the first recording medium being transported, disposed upstream of the fixing device 22.

At step 104 (S104), the fixing device 22 allows the first recording medium to pass it without heating the medium, according to the control conditions which are output by the conditions controller 900.

At step 106 (S106), the second recording medium length calculating part 904 receives the results of detection by the third sensor 42*a* and the fourth sensor 42*b* and calculates (detects) the length of the first recording medium being transported, disposed downstream of the fixing device 22 (in the loopback path 36).

The first recording medium whose length has thus been calculated is ejected through the ejection port 19.

At step 108 (S108), the paper feed unit 14 transports (feeds) a second recording medium, e.g., B4 size paper toward the transport path 20, according to control conditions which are output by the conditions controller 900.

At step 110 (S110), the first recording medium length calculating part 902 receives the results of detection by the first sensor 30*a* and the second sensor 30*b* and calculates (detects) the length of the second recording medium being transported, disposed upstream of the fixing device 22.

At step 112 (S112), the fixing device 22 allows the second recording medium to pass it without heating the medium, according to the control conditions which are output by the conditions controller 900.

At step 114 (S114), the second recording medium length calculating part 904 receives the results of detection by the third sensor 42*a* and the fourth sensor 42*b* and calculates (detects) the length of the second recording medium being transported, disposed downstream of the fixing device 22 (in the loopback path 36).

The second recording medium whose length has thus been calculated is ejected through the ejection port 19.

At step 116 (S116), the correspondence relation calculating part 908 retrieves from the recording medium length storing part 906 the results of calculation for the first recording medium and the second recording medium performed by the first recording medium length calculating part 902 and the results of calculation for the first recording medium and the second recording medium performed by the second recording medium length calculating part 904, and calculates a correspondence relation between the length of each recording medium detected with the aid of the first sensor 30*a* and the second sensor 30*b* (the length of each recording medium being disposed upstream of the fixing device 22) and the length of the same recording medium detected with the aid of the third sensor 42*a* and the fourth sensor 42*b* (the length of the recording medium being disposed downstream of the fixing device 22).

At step 118 (S118), the correspondence relation storing part 910 receives and stores the result of calculation from the correspondence relation calculating part 908.

Figure 9:
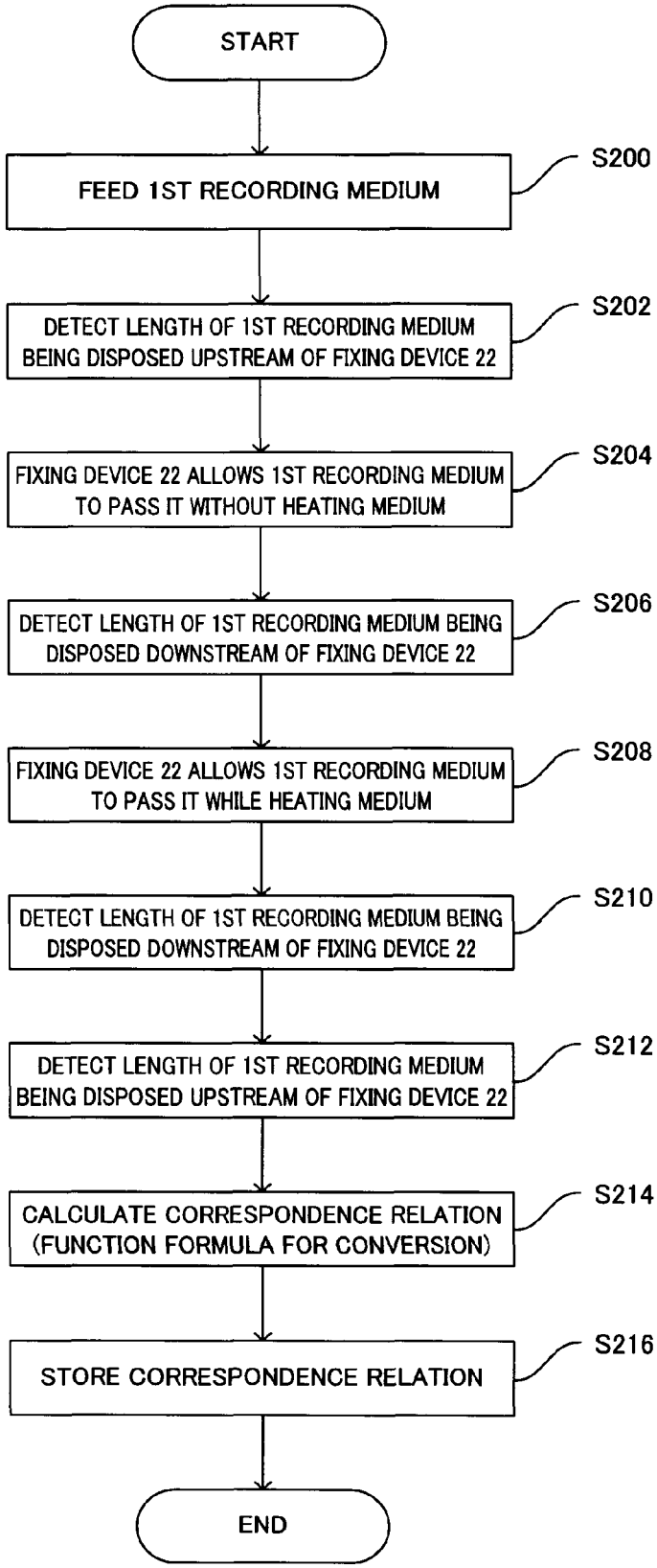
FIG. 9 is a flowchart illustrating a process (S20) that the image forming apparatus performs in a second sensor adjustment (calibration) mode.

FIG. 9 is a flowchart illustrating a process (S20) that the image forming apparatus performs in a second sensor adjustment (calibration) mode.

As is shown in FIG. 9, at step 200 (S200), the paper feed unit 14 transports (feeds) a first recording medium, e.g., A4 size paper toward the transport path 20, according to control conditions which are output by the conditions controller 900.

At step 202 (S202), the first recording medium length calculating part 902 receives the results of detection by the first sensor 30*a* and the second sensor 30*b*, and calculates (detects) the length of the first recording medium being transported, disposed upstream of the fixing device 22.

At step 204 (S204), the fixing device 22 allows the first recording medium to pass it without heating the medium, according to the control conditions which are output by the conditions controller 900.

At step 206 (S206), the second recording medium length calculating part 904 receives the results of detection by the third sensor 42*a* and the fourth sensor 42*b*, and calculates (detects) the length of the first recording medium being transported, disposed downstream of the fixing device 22 (in the loopback path 36).

At step 208 (S208), the fixing device 22 allows the first recording medium to pass it while heating the medium, according to the control conditions which are output by the conditions controller 900.

At step 210 (S210), the second recording medium length calculating part 904 receives the results of detection by the third sensor 42*a* and the fourth sensor 42*b*, and calculates (detects) the length of the first recording medium being transported, disposed downstream of the fixing device 22 (in the loopback path 36).

The first recording medium whose length after being heated has been calculated is returned from the loopback path 36 to the transport path 20.

At step 212 (S212), the first recording medium length calculating part 902 receives the results of detection by the first sensor 30*a* and the second sensor 30*b*, and calculates (detects) the length of the first recording medium being transported, disposed upstream of the fixing device 22.

At step 214 (S214), the correspondence relation calculating part 908 retrieves from the recording medium length storing part 906 the results of calculation for the first recording medium before being heated and after being heated, performed by the first recording medium length calculating part 902, and the results of calculation for the first recording medium before being heated and after being heated, performed by the second recording medium length calculating part 904, and calculates a correspondence relation between the length of the recording medium detected with the aid of the first sensor 30*a* and the second sensor 30*b* (the length of the recording medium being disposed upstream of the fixing device 22) and the length of the recording medium detected with the aid of the third sensor 42*a* and the fourth sensor 42*b* (the length of the recording medium being disposed downstream of the fixing device 22).

At step 216 (S216), the correspondence relation storing part 910 receives and stores the result of calculation from the correspondence relation calculating part 908.

Unless the rotational position (phase) of the transport rollers 38 when the third sensor 42*a* detects the lead edge of a recording medium in the transport direction is substantially equal to the rotational position (phase) of the transport rollers 38 when the fourth sensor 42*b* detects the trail edge of a recording medium in the transport direction, if the transport rollers 38 with a diameter of 14 mm have an outer circumferential runout of, e.g., several tens of micrometers (μm), attributed to manufacturing, such runout may result in a variation within several hundreds of micrometers (μm) in the length of a recording medium calculated by the second recording medium length calculating part 904. When a color image is produced, if, for example, due to misregistration or shrinkage of a recording medium, for example, an image in one color is misaligned by 100 μm, color misregistration may be perceived visually.

As noted above, when design consideration is taken so that the rotational position (phase) of the transport rollers 38 when the third sensor 42*a* detects the lead edge of a recording medium in the transport direction is substantially equal to the rotational position (phase) of the transport rollers 38 when the fourth sensor 42*b* detects the trail edge of a recording medium in the transport direction, it is confirmed by experiment that, even if the transport rollers 38 have an outer circumferential runout of, e.g., several tens of micrometers (μm), attributed to manufacturing, a variation in the length of a recording medium calculated by the second recording medium length calculating part 904 is suppressed to 50 μm or less.

Next, a description is provided for an example of an operation (color image print mode) of the image forming apparatus 10 after the correspondence relation storing part 910 stores the correspondence relation as noted above.

When a signal to form an image is delivered, the image carrier 24 is evenly charged by the charging device 52. Toward the charged image carrier 24, a beam corresponding to a yellow image is emitted from the optical projection device 58 based on the signal. The beam from the optical projection device 58 irradiates the surface of the image carrier 24, thereby forming an electrostatic latent image.

The paper feed unit 14 transports (feeds) a recording medium toward the transport path 20. The registration rollers 28 temporarily stop the recording medium and transport the medium toward the transfer position T at predetermined timing. When the registration rollers 28 start to transport the recording medium, the first sensor 30*a* detects the lead edge of the recording medium in the transport direction and the second sensor 30*b* detects the trail edge of the recording medium in the transport direction. The first recording medium length calculating part 902 calculates the length of the recording medium with no image formed thereon and outputs the result of first calculation to the image processing part 920.

The electrostatic latent image present on the image carrier 24 is developed with a yellow developer supplied to the development roller 48*a* in the development unit 46*a* and the developer image is transferred to the recording medium fed from the paper feed unit 14. The recording medium having the yellow developer image transferred thereto passes the fixing device 22 where the heating roller 60 and the pressure roller 62 apply heat and pressure to the medium, thereby fixing the developer image onto the medium.

Then, the recording medium having the yellow developer image fixed thereon is guided toward the loopback path 36 by the switching device 34. When the transport rollers 38 start to transport the recording medium, the third sensor 42*a* detects the lead edge of the recording medium in the transport direction and the fourth sensor 42*b* detects the trail edge of the recording medium in the transport direction. The second recording medium length calculating part 904 calculates the length of the recording medium having the yellow developer image fixed thereon and outputs the result of first calculation to the image processing part 920.

The transport rollers 40 transport the recording medium toward the registration rollers 28 in the transport path 20. Developer particles remaining on the image carrier 24 are scraped away by the image carrier cleaner 54.

The image processing part 920 receives the result of first calculation from the first recording medium length calculating part 902, the result of first calculation from the second recording medium length calculating part 904, and the above-mentioned correspondence relation (function formula for conversion) from the correspondence relation storing part 910. The image processing part 920 makes conversion so that each of the lengths of the recording medium calculated before and after the fixing device 22 heats the recording medium is regarded as the length of the recording medium detected with the aid of, for example, the third sensor 42*a* and the fourth sensor 42*b*. Then, the image processing part 920 calculates a shrinkage percentage (first shrinkage percentage) of the recording medium heated by the fixing device 22 and corrects an image signal corresponding to a magenta image, depending on the calculated shrinkage percentage.

The image carrier 24 is evenly charged again by the charging device 52. Toward the charged image carrier 24, a beam corresponding to a corrected magenta image is emitted from the optical projection device 58 which is controlled by the optical projection controller 922, based on the corrected image signal corresponding to the magenta image. The beam from the optical projection device 58 irradiates the surface of the image carrier 24, thereby forming an electrostatic latent image.

The electrostatic latent image present on the image carrier 24 is developed with a magenta developer supplied to the development roller 48*b* in the development unit 46*b*. The magenta developer image is overlayingly transferred to the recording medium timely transported by the registration rollers 28 after passing through the loopback path 36.

Again, when the registration rollers 28 start to transport the recording medium, the first sensor 30*a* detects the lead edge of the recording medium in the transport direction and the second sensor 30*b* detects the trail edge of the recording medium in the transport direction. The first recording medium length calculating part 902 calculates the length of the recording medium that has passed once the fixing device 22 where the heating roller 60 heats the medium and outputs the result of second calculation to the image processing part 920.

The recording medium having the magenta developer image transferred thereto passes the fixing device 22 where the heating roller 60 and the pressure roller 62 applies heat and pressure to the medium, thereby fixing the developer image onto the medium.

Then, the recording medium having the magenta developer image fixed thereon is guided toward the loopback path 36 by the switching device 34. When the transport rollers 38 start to transport the recording medium, the third sensor 42*a* detects the lead edge of the recording medium in the transport direction and the fourth sensor 42*b* detects the trail edge of the recording medium in the transport direction. The second recording medium length calculating part 904 calculates the length of the recording medium having the yellow and magenta developer images fixed thereon, and outputs the result of second calculation to the image processing part 920.

The transport rollers 40 transport the recording medium toward the registration rollers 28 in the transport path 20. Developer particles remaining on the image carrier 24 are scraped away by the image carrier cleaner 54.

The image processing part 920 receives the result of second calculation from the first recording medium length calculating part 902, the result of second calculation from the second recording medium length calculating part 904, and the above-mentioned correspondence relation (function formula for conversion) from the correspondence relation storing part 910. The image processing part 920 makes conversion so that each of the lengths of the recording medium calculated before and after the fixing device 22 heats the recording medium is regarded as the length of the recording medium detected with the aid of, for example, the third sensor 42*a* and the fourth sensor 42*b*. Then, the image processing part 920 calculates a shrinkage percentage (second shrinkage percentage) of the recording medium heated again by the fixing device 22 and corrects an image signal corresponding to a cyan image, depending on the calculated shrinkage percentage.

A cyan developer image corrected according to the second shrinkage percentage is transferred in the same way as for the yellow and magenta images and fixed onto the recording medium by the fixing device 22. In the same manner, a black developer image is corrected according to a third shrinkage percentage, transferred in the same way as for the yellow, magenta, and cyan developer images, and fixed onto the recording medium by the fixing device 22.

When the developer images developed with the developers of four colors are fixed onto the recording medium by the fixing device 22, a color image into which the developer images have been combined is formed on the recording medium. The recording medium having the color image fixed thereon is guided to the eject rollers 23 by the switching device 34 and ejected.

In the exemplary embodiment described hereinbefore, the description has been provided for an example in which a composite image is formed by overprinting the developer images on one side of a recording medium. However, the scope of the invention is not so limited. The image forming apparatus may form images on both sides of a recording medium such as, e.g., paper; that is, by applying heat and pressure to developer images transferred to one side of the medium, the developer images are fixed onto the medium, and then developer images are transferred and fixed onto the reverse side of the medium.

In the exemplary embodiment described hereinbefore, the description has been provided for an example in which an image is formed by an image forming unit including the image carrier 24, the charging device 52, the optical projection device 58, the rotary development device 45, and other components. However, the scope of the invention is not so limited. The image forming unit may be, for example, an ink jet type.

The present invention may be embodied in other specific forms without departing from its spirit or characteristics. The described exemplary embodiment is to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An image forming apparatus comprising:

an image forming unit that forms an image on a recording medium;

a fixing unit that fixes the image formed on the recording medium by the image forming unit by applying heat;

a first detector unit that detects a length of the recording medium in a transport direction, the first detector unit being disposed upstream of the fixing unit in the transport direction;

a second detector unit that detects the length of the recording medium in the transport direction, the second detector unit being disposed downstream of the fixing unit in the transport direction;

a correspondence relation calculating unit that calculates a correspondence relation between results of detection by the first detector unit and the second detector unit;

an image formation controller that controls the image forming unit, based on a result of calculation performed by the correspondence relation calculating unit; and a conditions controller that controls operating conditions of the fixing unit so that the fixing unit allows the recording medium to pass the fixing unit without applying heat at least once, when the correspondence relation calculating unit calculates a correspondence relation.

2. The image forming apparatus according to claim 1, wherein the first detector unit and the second detector unit detect lengths of a plurality of types of recording media having different lengths in the transport direction; and the correspondence relation calculating unit calculates a correspondence relation between the results of detection by the first detector unit and the second detector unit for the plurality of types of recording media.

3. An image forming apparatus comprising:

an image forming unit that forms an image on a recording medium;

a fixing unit that fixes the image formed on the recording medium by the image forming unit by applying heat;

a first detector unit that detects a length of the recording medium in a transport direction, the first detector unit being disposed upstream of the fixing unit in the transport direction;

a second detector unit that detects the length of the recording medium in the transport direction, the second detector unit being disposed downstream of the fixing unit in the transport direction;

a correspondence relation calculating unit that calculates a correspondence relation between results of detection by the first detector unit and the second detector unit;

an image formation controller that controls the image forming unit, based on a result of calculation performed by the correspondence relation calculating unit; and a conditions controller that controls operating conditions of a fixing unit so that each of the first detector unit and the second detector unit detects the length of a recording medium to which the fixing device does not apply heat and the length of the recording medium to which the fixing device has applied heat, when the correspondence relation calculating unit calculates a correspondence relation.

4. The image forming apparatus according to claim 3, wherein the first detector unit and the second detector unit detect lengths of a plurality of types of recording media having different lengths in the transport direction; and the correspondence relation calculating unit calculates a correspondence relation between the results of detection by the first detector unit and the second detector unit for the plurality of types of recording media.

5. An image forming apparatus comprising:

an image forming unit that forms an image on a recording medium;

a fixing unit that fixes the image formed on the recording medium by the image forming unit by applying heat;

a first detector unit that detects a length of the recording medium in a transport direction, the first detector unit being disposed upstream of the fixing unit in the transport direction;

a second detector unit that detects the length of the recording medium in the transport direction, the second detector unit being disposed downstream of the fixing unit in the transport direction; and a pair of transport members, each having a substantially cylindrical shape, that transport a recording medium at a predetermined transport speed by rotating, while nipping the recording medium therebetween, the second detector unit including:

a lead edge detector that detects a lead edge of a recording medium in the transport direction, as the pair of transport members transport the recording medium;

a trail edge detector that detects a trail edge of a recording medium in the transport direction, as the pair of transport members transport the recording medium; and a recording medium length calculating unit that calculates a length of a recording medium in the transport direction, based on time elapsed after the lead edge detector detects the lead edge of the recording medium in the transport direction until the trail edge detector detects the trail edge of the recording medium in the transport direction and a distance between a detection position of the lead edge detector and a detection position of the trail edge detector, wherein the distance between the detection position of the lead edge detector and the detection position of the trail edge detector can be set to be substantially equal to a length calculated by subtracting an integral multiple of a circumferential length of each of the pair of transport members from a predetermined standard length of a recording medium.

6. The image forming apparatus according to claim 5, wherein the lead edge detector and the trail edge detector are arranged so that the distance between the detection position of the lead edge detector and the detection position of the trail edge detector can be set to be substantially equal to each length calculated by subtracting an integral multiple of the circumferential length of each of the pair of transport members from each of predetermined standard lengths proper to a plurality of types of recording media.

7. An image forming apparatus comprising:

an image forming unit that forms an image on a recording medium;

a fixing unit that fixes the image formed on the recording medium by the image forming unit by applying heat;

a first detector unit that detects a length of the recording medium in a transport direction, the first detector unit being disposed upstream of the fixing unit in the transport direction;

a second detector unit that detects the length of the recording medium in the transport direction, the second detector unit being disposed downstream of the fixing unit in the transport direction;

a first pair of transport members disposed upstream of the fixing unit in the transport direction, each having a substantially cylindrical shape, that transport a recording medium at a predetermined transport speed by rotating, while nipping the recording medium therebetween; and a second pair of transport members disposed downstream of the fixing unit in the transport direction, each having a substantially cylindrical shape, that transport a recording medium at a predetermined transport speed by rotating, while nipping the recording medium therebetween, the first detector unit including:

a first lead edge detector that detects a lead edge of a recording medium in the transport direction, as the first pair of transport members transport the recording medium;

a first trail edge detector that detects a trail edge of a recording medium in the transport direction, as the first pair of transport members transport the recording medium; and a first recording medium length calculating unit that calculates the length of a recording medium in the transport direction, based on time elapsed after the first lead edge detector detects the lead edge of the recording medium in the transport direction until the first trail edge detector detects the trail edge of the recording medium in the transport direction and a distance between a detection position of the first lead edge detector and a detection position of the first trail edge detector, wherein the distance between the detection position of the first lead edge detector and the detection position of the first trail edge detector can be set to be substantially equal to a length calculated by subtracting an integral multiple of a circumferential length of each of the first pair of transport members from a predetermined standard length of a recording medium, the second detector unit including:

a second lead edge detector that detects a lead edge of a recording medium in the transport direction, as the second pair of transport members transport the recording medium;

a second trail edge detector that detects a trail edge of a recording medium in the transport direction, as the second pair of transport members transport the recording medium; and a second recording medium length calculating unit that calculates the length of a recording medium in the transport direction, based on time elapsed after the second lead edge detector detects the lead edge of the recording medium in the transport direction until the second trail edge detector detects the trail edge of the recording medium in the transport direction and a distance between a detection position of the second lead edge detector and a detection position of the second trail edge detector, wherein the distance between the detection position of the second lead edge detector and the detection position of the second trail edge detector can be set to be substantially equal to a length calculated by subtracting an integral multiple of a circumferential length of each of the second pair of transport members from a predetermined standard length of a recording medium.

8. The image forming apparatus according to claim 7, wherein the first lead edge detector and the first trail edge detector are arranged so that the distance between the detection position of the first lead edge detector and the detection position of the first trail edge detector can be set to be substantially equal to each length calculated by subtracting an integral multiple of the circumferential length of each of the first pair of transport members from each of predetermined standard lengths proper to a plurality of types of recording media; and the second lead edge detector and the second trail edge detector are arranged so that the distance between the detection position of the second lead edge detector and the detection position of the second trail edge detector can be set to be substantially equal to each length calculated by subtracting an integral multiple of the circumferential length of each of the second pair of transport members from each of predetermined standard lengths proper to a plurality of types of recording media.

* * * * *